United States Patent [19]

Springston

[11] 4,302,162

[45] * Nov. 24, 1981

[54] WATER PUMPING DEVICE

[75] Inventor: Jefferson J. Springston, Pasadena, Md.

[73] Assignee: Lipman Electric Company, Inc., Owings Mills, Md.

[ * ] Notice: The portion of the term of this patent subsequent to Jan. 27, 1998, has been disclaimed.

[21] Appl. No.: 197,064

[22] Filed: Oct. 15, 1980

Related U.S. Application Data

[63] Continuation of Ser. No. 944,978, Sep. 22, 1978, Pat. No. 4,247,261.

[51] Int. Cl.[3] ..... F04B 17/06

[52] U.S. Cl. ..... 417/424; 405/61

[58] Field of Search ..... 417/423 R, 424, 44, 417/14, 32; 405/52, 61, 62, 217, 211; 60/221; 415/7, 47

[56] References Cited

U.S. PATENT DOCUMENTS

| | | | |
|---|---|---|---|
| 1,683,949 | 9/1928 | Bergdoll | 417/424 |
| 2,860,835 | 11/1958 | Schade | 417/424 X |
| 2,991,622 | 7/1961 | Oster | 405/61 |
| 3,083,538 | 4/1963 | Gross | 405/61 |
| 3,309,846 | 3/1967 | Schneider | 416/95 X |
| 3,320,160 | 5/1967 | Welles et al. | 405/52 X |
| 3,524,629 | 8/1970 | Culwell | 415/7 |
| 3,540,222 | 11/1970 | Mendelson | 405/52 |
| 4,089,620 | 5/1978 | Ravitts | 415/7 X |
| 4,221,538 | 9/1980 | Wells | 415/7 X |
| 4,247,261 | 1/1981 | Springston | 417/44 |

OTHER PUBLICATIONS

"Changing Our Climate" by Camille Rougeron, *The Detroit News,* Thurs., Dec. 19, 1957.

*Primary Examiner*—Carlton R. Croyle
*Assistant Examiner*—Edward Look
*Attorney, Agent, or Firm*—LeBlanc, Nolan, Shur & Nies

[57] ABSTRACT

A venturi-type water pumping device is provided which is immersible in a body of water to pump warm water from its lower depths toward its surface to maintain the water surface free of ice. The water pumping device comprises a hollow, generally cylindrical housing having opposite outwardly flared ends with a propeller and drive motor mounted within the housing. When the device is suspended in a body of water and the propeller rotated, warm water is drawn upwardly through the housing and emerges as a column of water directed upwardly toward the water surface. The water pumping device is adapted to be suspended either vertically or at an angle to the vertical. The device is also adapted to operate while at rest on the bottom of the body of water.

4 Claims, 5 Drawing Figures

WATER PUMPING DEVICE

This is a continuation of application Ser. No. 944,978, filed 9/22/78, now U.S. Pat. No. 4,247,261.

The present invention relates to a water pumping device adapted to be immersed in a body of water to pump water from its lower depths toward the water surface. Specifically, this invention relates to a venturi-type water pumping device which is suspended below the surface of a body of water and operates as a de-icer by drawing warm water from the lower depths and directing a column of warm water upwardly to keep the water surface free of ice or to melt ice at the surface. The invention is advantageously adapted to be suspended either vertically or at an angle to the vertical and to operate while at rest on the bottom of the body of water.

In marinas and navigable waterways, the formation of ice on the water surface can severely damage boats and docks and prevent the passage of boats through the water. Thus, when the air temperatures above the water surface drops below the freezing point, it is essential to keep the areas around the boats and docks free of ice to prevent damage and to maintain open areas clear of ice to allow the boats to navigate over the water surface. It is well known that, with the air temperature below the freezing point, although ice tends to form at the water surface, warmer water located several feet below the surface does not freeze. Accordingly, a water pumping device adapted to be immersed below the water surface and to pump warm water from its lower depths upward can be advantageously employed to keep the water surface free of ice and melt surface ice.

Although various water pumping devices have been previously proposed, such devices are generally complicated in design and expensive to manufacture. See, for example, U.S. Pat. Nos. 3,083,538, 2,827,268, 2,991,622, 3,365,178, 3,540,222, 3,667,873, and 4,033,704. Generally, some of the prior art devices tend to produce a divergent, cone-shaped stream of water which dilutes the warming effect at the water surface. Other prior art devices require enlarged vertical tubes to pump the water upwardly which are expensive and unwieldy in design and extremely difficult to handle and maneuver. Several of the prior art units are intended to be anchored to the bottom of the body of water. Such devices are not readily maneuverable to vary the orientation of the water flow to the surface. None of the prior art devices provides the option of operating either in a suspended position or in a position at rest at the bottom of water.

The present invention contemplates a venturi-type water pumping device immersible in a body of water which draws a stream of water from its warmer, lower depths and directs the stream of warm water upwardly to keep the water surface free of ice or to melt the surface ice. The water pumping device comprises a hollow, cylindrical housing having opposite outwardly flared ends and a propeller rotatably mounted within the housing. When the propeller is rotated, the housing acts as a venturi which produces an upwardly directed column of warm water. The water pumping device is especially suitable for use in marinas to clear ice from areas around boats and docks and to maintain open areas free of ice for navigation. The water pumping device is conveniently suspendable below the water surface, either vertically or at an angle to the vertical. It is also adapted to operate while resting on the bottom of the body of water.

In accordance with the invention, the water pumping device comprises a hollow, cylindrically shaped housing having opposite outwardly flared ends, means for suspending the housing within a body of water at a desired depth below its surface, a propeller rotatably mounted within the housing, and a drive motor for rotating the propeller to draw water through the housing and to direct a column of water upwardly toward the surface. Preferably, the suspending means is adjustable to allow the housing to be oriented vertically or at an angle to the vertical. The housing is advantageously provided with inlet means for admitting water into the housing with the device at rest on the bottom of the body of water. In addition, the device may be provided with control means responsive to the air temperature above the water surface to actuate the drive motor at a predetermined temperature.

A preferred embodiment of the water pumping device includes a hollow, cylindrically-shaped housing having an open top end and an open bottom end with outwardly flared flanges formed at both ends. A propeller is rotatably mounted within the housing with its axis of rotation in alignment with the axis of the housing. When the device is immersed in a body of water and the propeller rotated, warm water from the lower depths is drawn into the open bottom end of the housing and a column of warm water is directed upwardly from its open top end toward the water surface. Preferably, a pair of suspension lines is attached to the top flange of the housing to enable the device to be suspended at a desired depth below the surface. A pair of mounting holes may be located at diametrically opposed positions on the top flange to allow the lines to be attached to the flange to suspend the housing with its axis oriented vertically. One or more additional mounting holes may be spaced about the periphery of the top flange to allow the lines to be attached at different positions to suspend the housing with its axis at an angle to the vertical.

A preferred embodiment of the invention includes a plurality of inlet ports formed in the housing and disposed below the drive motor to allow water to be drawn into the housing when the device rests on the bottom of the body of water. This feature advantageously allows the device to be operated either while suspended below the water surface or at rest on the bottom of the body of water. The device preferably includes a self-lubricating electric motor which is sealed to prevent water leakage into the motor. A power cord extends from the motor and includes a plug for connecting the motor to a conventional power supply above the water surface. Preferably, the plug includes a thermostat responsive to the air temperature above the water surface to actuate the motor at a predetermined temperature. Alternatively, a time control device may be used to actuate the motor at predetermined times.

The venturi-type water pumping device of the present invention advantageously produces more water turbulence with the same size motor in comparison with the prior art devices which achieve a conical water stream. As a result, the present device produces a powerful water column which can be advantageously directed to the water surface to maintain it free of ice.

Accordingly, it is an object of this invention to provide a venturi-type water pumping device immersible in a body of water to pump warm water from its lower depths upwardly to maintain the water surface free of ice.

It is also an object of the invention to provide an improved water pumping device which can be suspended below the water surface either vertically or at an angle to the vertical.

Another object of the invention is to provide a water pumping device immersible in a body of water produces a turbulent column of warm water from its lower depths which can be directed upwardly toward the water surface.

A further object of the invention is to provide a water pumping device adapted to operate while at rest on the bottom of the body of water.

It is another object of the invention to provide an improved water pumping device which is simple in design and easy to manufacture.

These and other objects will be readily apparent with reference to the drawings and following descriptions wherein.

Figure 1:
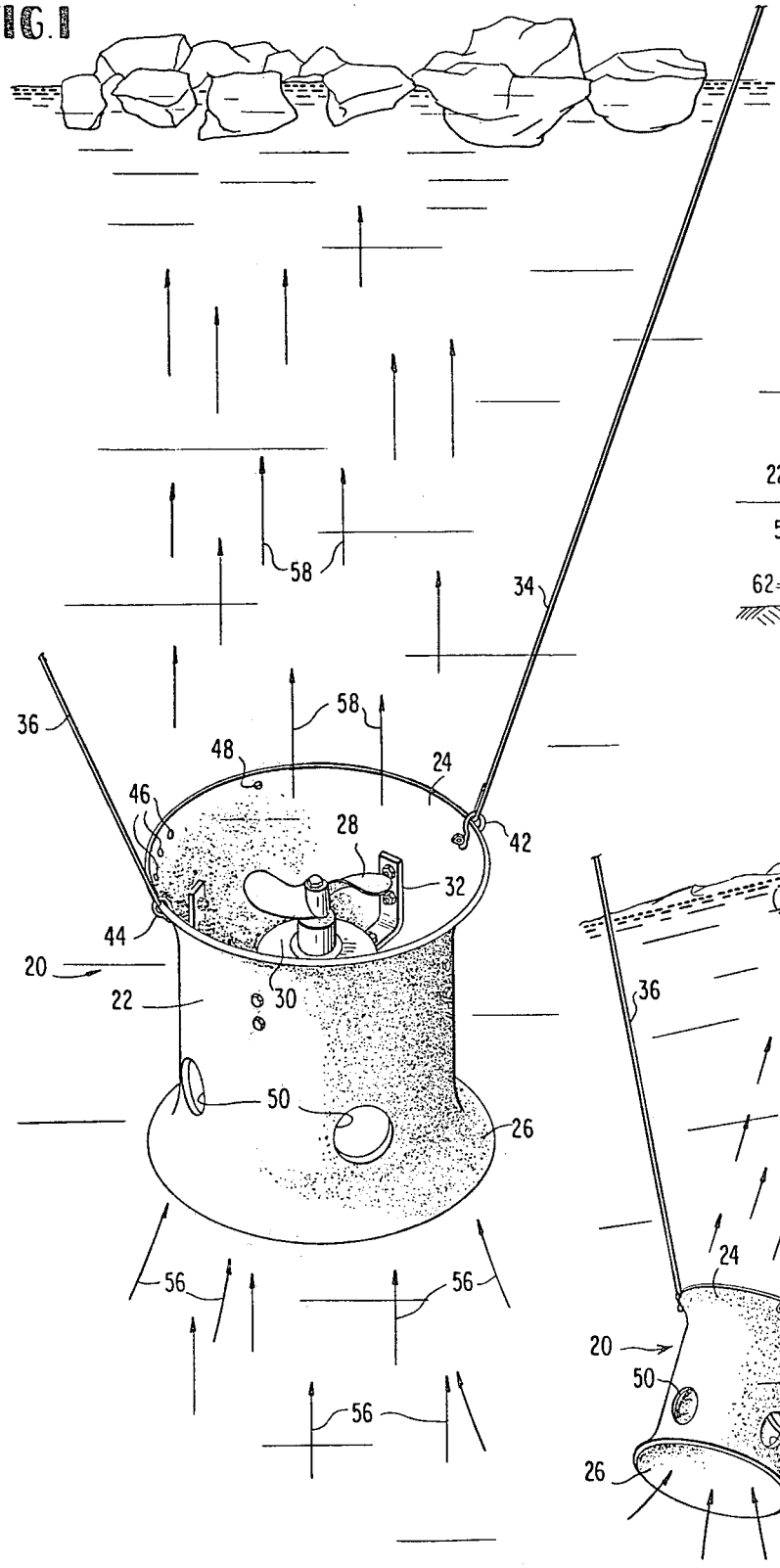
FIG. 1 is a perspective view of a water pumping device embodying the present invention suspended below the surface of a body of water.

Referring to FIG. 1, a water pumping device, generally 20, includes a hollow, cylindrically-shaped housing having an upper, outwardly flared flange 24 at its open top end and a lower, outwardly flared flange 26 at its open bottom end. A propeller 28 is rotatably mounted within housing 22 on a drive motor 30 which is bolted to the housing by a set of mounting brackets 32. Preferably, drive motor 30 is a self-lubricating electric motor which is sealed to prevent water leakage. Propeller 28 is mounted with its axis of rotation in alignment with the axis of cylindrical housing 22. Although propeller 28 is shown with twin helical blades, it will be understood that other propeller configurations may be employed.

Figure 3:
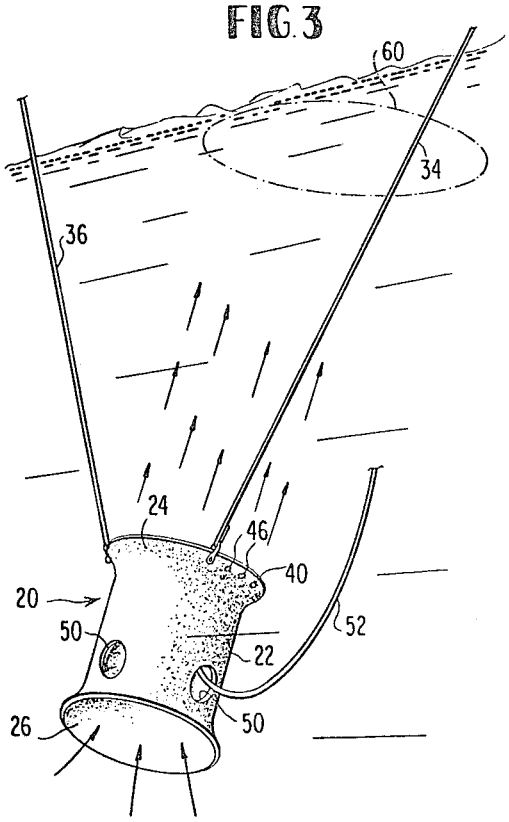
FIG. 3 is a perspective view illustrating the water pumping device suspended at an angle to the vertical.
Figure 4:
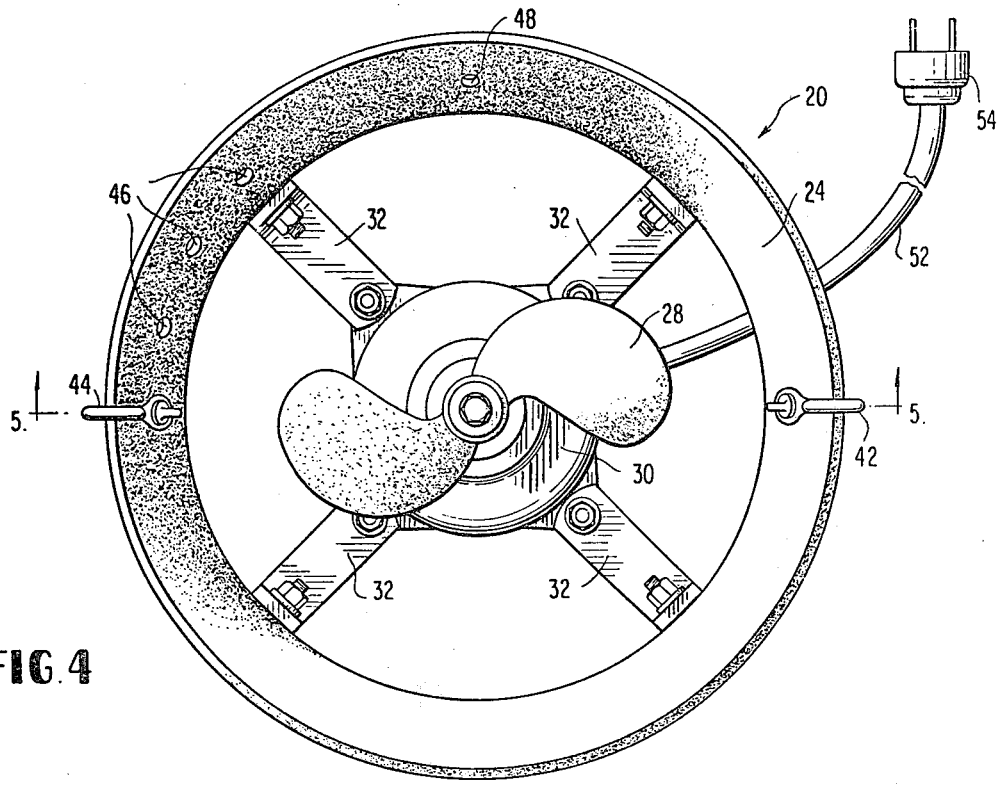
FIG. 4 is an enlarged plan view of the water pumping device.
Figure 5:
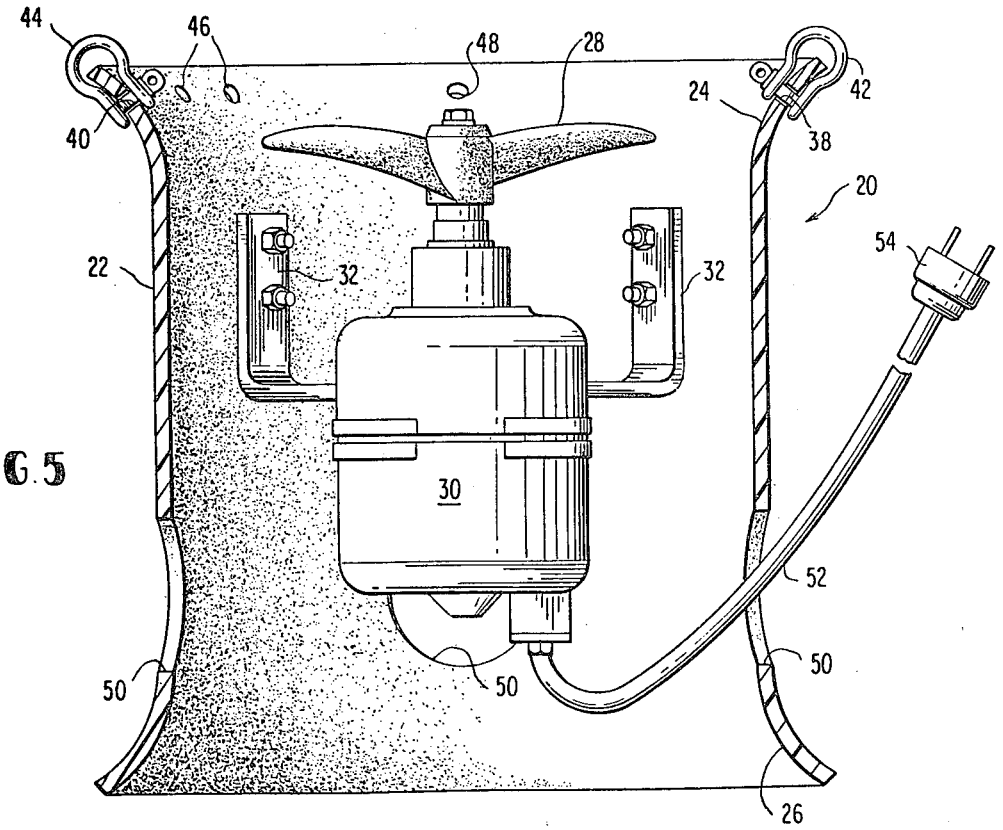
FIG. 5 is an employed elevation view, partially in section, of the water pumping device taken along line 5—5 of FIG. 4.

The preferred embodiment includes a pair of suspension lines 34 and 36 attached to top flange 24 to suspend the water pumping device within a body of water at a desired depth below its surface. To suspend housing 22 with its axis oriented vertically, suspension lines 34 and 36 are attached at diametrically opposed positions on top flange 24. Preferably, as shown in FIG. 5, a pair of mounting holes 38 and 40 is formed at diametrically opposed positions in top flange 24. A pair of lugs 42 and 44 is secured to top flange 24 through mounting holes 38 and 40, respectively, for attachment to suspension lines 34 and 36. The suspension lines may consist of a pair of ropes, cables, chains or other suitable devices. To allow housing 22 to be suspended at an angle to the vertical, additional mounting holes may be spaced about the periphery of top flange 24. As shown in FIGS. 4 and 5, a set of three equidistantly spaced mounting holes 46 is provided in top flange 24 adjacent to mounting hole 40. Another mounting hole 48 is provided in top flange 24 equidistant from diametrically opposed mounting holes 38 and 40. These additional mounting holes allow suspension lines 34 and 36 to be attached to top flange 24 at different positions to suspend housing 22 with its axis at an angle to the vertical (FIG. 3).

Figure 2:
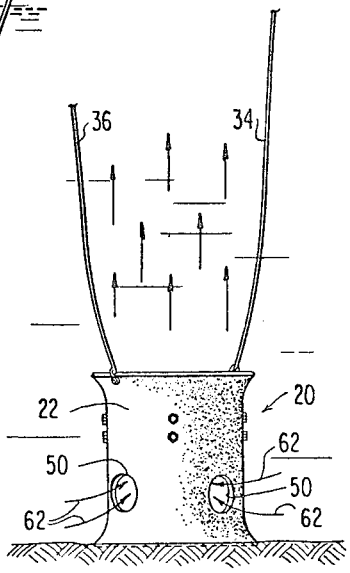
FIG. 2 is side view of the water pumping device at rest on the bottom of the body of water.

As shown in FIGS. 1 and 5, the preferred embodiment of the water pumping device includes a plurality of inlet ports 50 formed in the side of housing 22 and disposed below propeller 28 and drive motor 30. These inlet ports allow water to be drawn into housing 22 when the device rests on the bottom of the body of water (FIG. 2).

Referring to FIG. 5, a power cord 52 extends downwardly from drive motor 30 and outwardly through one of inlet ports 50 and includes a plug 54 for connection to a conventional power supply located above the water surface, e.g., on a dock or boat. The downward and outward path of power cord 52 minimizes any danger of its fouling and being sliced by propeller 28.

Plug 54 preferably incorporates a thermostat responsive to the air temperature above the water surface to actuate drive motor 30 at a predetermined temperature. For example, the thermostat may be designed to turn on motor 30 when the air temperature drops to 30° F. and to turn off the motor when the temperature rises to 36° F. Alternatively, a time control circuit (not shown) may be used to actuate the motor for a predetermined time period.

In its operation, water pumping device 20 is suspended at a desired depth, e.g., 3 or 4 feet below the water surface, via lines 34 and 36. When drive motor 30 is actuated to rotate propeller 28, warm water from the lower depths is drawn upward, as indicated by arrows 56 (FIG. 1), into the open bottom end of housing 22. The action of propeller 28 draws the warm water upwardly through housing 22 which acts as a venturi to produce a column of warm water (indicated by arrows 58) which emerges from the open top end of the housing. The column of warm water is directed upward for several feet to melt ice at the water surface and to keep the surface clear of ice.

When water pumping device 20 is disposed vertically in the body of water, the water pumping device tends to clear a circular area directly above it. Alternatively, with water pumping device 20 oriented at an angle to the vertical (FIG. 3), it tends to clear an oblong area 60 at the water surface.

Typically, water pumping device 20 is suspended from a dock to maintain the area adjacent to its pilings free of ice. Electric drive motor 30 is connected to a conventional power source located on the dock. However, it is also contemplated that the water pumping device may be operated in a position at rest at the bottom of the body of water (FIG. 2). This mode of operation is particularly suitable when the water pumping device is suspended from a boat. Inlet ports 50 allow warm water to be drawn into housing 22 (as indicated by arrows 62) which emerges from its open top end as a column of water directed upwardly toward the water surface.

One example of the water pumping device of this invention utilized an electric motor rated at ⅓ horsepower which draws approximately 11½ amps at 1750 rpm. This device was operated for 48 hours in a marina having ten inches of ice to clear an oblong area 40 feet by 60 feet.

In conclusion, the water pumping device of this invention provides an efficient and inexpensive unit which produces a turbulent column of warm water from the lower depths of a body of water to maintain its surface free of ice or to melt surface ice. The water pumping device may be advantageously operated while suspended below the water surface either in a vertical orientation or an angle to the vertical. In addition, the water pumping device is operable while at rest on the bottom of the body of water.

While a specific embodiment of the invention has been shown and described in detail, it will be understood that the invention may be modified without departing from the spirit of the inventive principles as set forth in the appended claims.

What is claimed is:

1. A device adapted to be submerged in a body of water or to rest on the bottom thereof for protecting boats and docks from ice by generating a column of water from the lower depths of said body of water and directing said column upwardly to the surface thereof which may be suspended from the boat or dock to be protected comprising:

a hollow, elongated, circular in cross section housing the upper portion thereof forming an upwardly directed outlet opening for expelling and directing a column of water upwardly, said opening being contained in a plane disposed normal to the longitudinal axis of said housing, and inlet means carried by said housing in the lower portion thereof for admitting water to the interior thereof;

adjustable suspension means for selectively suspending said housing, submerged, in the body of water whereby the longitudinal axis thereof is disposed at a predetermined angle to the vertical with the outlet directed upwardly; said means comprising a pair of suspension lines; connecting means carried by said device for connecting an end of each of said lines to the upper portion of said housing adjacent the outlet in a mutually spaced relationship at the periphery of the outlet whereby the opposite end of each line may be secured to a boat or dock to suspend said housing in a predetermined position in the body of water;

means mounted within the housing between the inlet means and the outlet for drawing water into the housing and for expelling water in a column through the outlet comprising an electric motor and means for selectively coupling said motor to a source of electrical energy and a propeller coupled to and driven by said motor whereby rotation of said propeller will draw water into said housing and expell the water from the housing through the outlet.

2. The device of claim 1 wherein the inlet means includes a plurality of mutually spaced ports through the lower portion of said housing.

3. The device of claim 1 wherein said connecting means further comprises:

a pair of mounting holes located at diametrically opposed positions on the upper portion of said housing adjacent the outlet whereby said suspension lines may be attached to said housing to suspend said housing with its axis oriented vertically.

4. The device of claim 3 wherein said connecting means further comprises:

one or more additional mounting holes spaced about the upper portion of said housing adjacent the outlet to allow said lines to be attached at different positions whereby said housing may be suspended with its axis at an angle to the vertical.

* * * * *

REEXAMINATION CERTIFICATE (500th)

United States Patent [19]

Springston

[11] B1 4,302,162

[45] Certificate Issued * May 6, 1986

[54] WATER PUMPING DEVICE

[75] Inventor: Jefferson J. Springston, Pasadena, Md.

[73] Assignee: Lipman Electric Company, Inc., Owings Mills, Md.

Reexamination Request:
No. 90/000,543, Apr. 17, 1984

Reexamination Certificate for:

| | |
|---|---|
| Patent No.: | **4,302,162** |
| Issued: | **Nov. 24, 1981** |
| Appl. No.: | **197,064** |
| Filed: | **Oct. 15, 1980** |

[ * ] Notice: The portion of the term of this patent subsequent to Jan. 27, 1998 has been disclaimed.

Related U.S. Application Data

[63] Continuation of Ser. No. 944,978, Sep. 22, 1978, Pat. No. 4,247,261.

[51] Int. Cl.[4] ..... F04B 17/06
[52] U.S. Cl. ..... 417/424; 405/61
[58] Field of Search ..... 417/423 R, 424, 44, 417/14, 32, 360, 361, 61; 405/52, 61, 62, 217, 211; 60/221; 415/7, 47

[56] References Cited

U.S. PATENT DOCUMENTS

| | | | |
|---|---|---|---|
| 2,621,849 | 12/1954 | Minnis | 417/361 |
| 3,083,538 | 4/1963 | Gross | 405/61 |

FOREIGN PATENT DOCUMENTS

| | | | |
|---|---|---|---|
| 936006 | 10/1973 | Canada | 61/30 |

OTHER PUBLICATIONS

1975 Ice-Away De-Icers (5 page brochure), Jul. 1974.
The Boating Industry, Dec. 1975 Issue, p. 49 describes Ice-Away.
Bill Scott's No-Icer Slinger (2 page brochure) Aug. 19, 1977.
Don't Lift Boats This Winter! (2 page brochure) Sep. 1975.

*Primary Examiner*—Edward Look

[57] ABSTRACT

A venturi-type water pumping device is provided which is immersible in a body of water to pump warm water from its lower depths toward its surface to maintain the water surface free of ice. The water pumping device comprises a hollow, generally cylindrical housing having opposite outwardly flared ends with a propeller and drive motor mounted within the housing. When the device is suspended in a body of water and the propeller rotated, warm water is drawn upwardly through the housing and emerges as a column of water directed upwardly toward the water surface. The water pumping device is adapted to be suspended either vertically or at an angle to the vertical. The device is also adapted to operate while at rest on the bottom of the body of water.

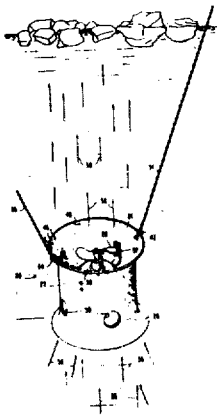

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *